United States Patent [19]

Snygg

[11] Patent Number: 4,778,122

[45] Date of Patent: Oct. 18, 1988

[54] APPARATUS FOR TRANSFERRING REEL DRUMS TO THE WINDER OF A PAPER OR BOARD MACHINE

[75] Inventor: Keijo K. Snygg, Karhula, Finland

[73] Assignee: A. Ahlstrom Corporation, Karhula, Finland

[21] Appl. No.: 19,786

[22] Filed: Feb. 27, 1987

[30] Foreign Application Priority Data

Feb. 27, 1986 [FI] Finland ..... 860834

[51] Int. Cl.[4] ..... B65H 19/30

[52] U.S. Cl. ..... 242/58.6; 242/65; 414/911

[58] Field of Search ..... 242/58.6, 56 R, 65; 414/276, 77, 279, 80, 745, 748, 911

[56] References Cited

U.S. PATENT DOCUMENTS

| | | | |
|---|---|---|---|
| 2,508,566 | 5/1950 | Dunton | 242/58.6 |
| 3,586,253 | 6/1971 | Gilbank . | |
| 3,610,545 | 10/1971 | Reifenhauser | 242/56 R |
| 4,687,404 | 8/1987 | Seiz et al. | 414/276 |

FOREIGN PATENT DOCUMENTS

| | | |
|---|---|---|
| 2427466 | 6/1975 | Fed. Rep. of Germany . |
| 51463 | 5/1979 | Finland . |

*Primary Examiner*—Stuart S. Levy
*Assistant Examiner*—Steven M. DuBois
*Attorney, Agent, or Firm*—Nixon & Vanderhye

[57] ABSTRACT

A method of charging reel drums (4) of a paper or a board manufacturing machine winder to the front end of a store (12) disposed on top of the winder; and of lowering the reel drums (4) from the store (12). During the charge of the reel drums (4) to the store, the reel drums (4) already in the store (12) are pushed from the front end (13), i.e. loading and discharge end of the store towards the rear end at least by a distance (D) equal to the diameter of the reel drum (4). When a reel drum (15) is lowered, the drums (4) which are in the store displaced at a distance equal to the reel drum diameter from the front end (13) of the store (12), are kept in place.

15 Claims, 7 Drawing Sheets

APPARATUS FOR TRANSFERRING REEL DRUMS TO THE WINDER OF A PAPER OR BOARD MACHINE

Figure 1:
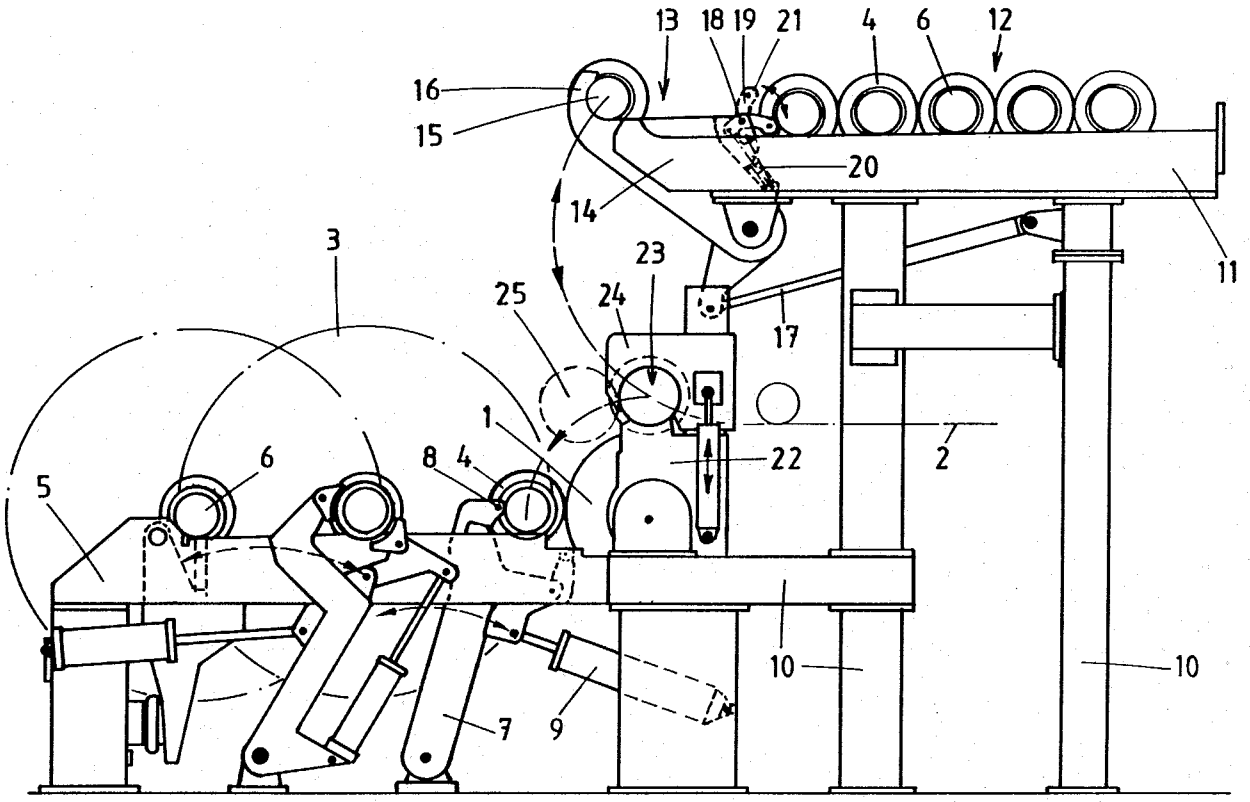

The present invention relates to a method of charging reel drums for a winder of a paper or a board machine to a store which is partly on top of the winder; and to a method of lowering the reel drums from the front end of the store during reel drum exchange.

The invention also relates to an apparatus for charging the reel drums to a store and for lowering the drums from the store one by one during a reel drum exchange of a paper or a board machine, the apparatus comprising at least two support rails disposed substantially in a horizontal position or inclined in the machine direction and extending from above the winder towards the paper or the board machine, for carrying the reel drums in the store;

two end stops, one for each support rail end closest to the winder, for preventing the drums from rolling down the rails;

two lowering arms for lowering the reel drums from the support rails to a pre-start position for a reel drum exchange.

Paper and board manufacturing machines usually have a winder which winds a finished web around a reel drum thus producing a "jumbo" roll of the same width as the whole machine.

A typical winder is mainly composed of a water-cooled roller cylinder made of cast iron (a so-called "Pope cylinder") the diameter of which varies from 1100 mm to 1500 mm. The cylinder is rotated at a constant speed so as to create an appropriate tension between the winder and the paper or the board machine. The jumbo roll leans against the roller cylinder and rotates at a constant speed irrespective of its increasing diameter. A new reel drum is lifted with a crane to primary arms above the cylinder to a pre-start position for a reel drum exchange. A locking means of the primary arms holds the reel drum on the arms. The reel drum does not touch the roller cylinder yet, but the reel drum is pre-started for instance by a rubber wheel or a belt driven by a DC motor. Thus the periphery of the reel drum reaches almost the peripheral speed of the roller cylinder. When a jumbo roll has reached a desired diameter the roll is detached from the roller cylinder and its peripheral speed decreases. A new reel drum is lowered by the primary arms along the periphery of the cylinder to the reel drum exchange position, where it contacts the cylinder and reaches its peripheral speed. Because of the speed difference, the web has formed a loop which is guided so as to be wound around the new reel drum while the web is broken at the finished jumbo roll. The completed jumbo roll is removed and the new reel drum is lowered down to the winding position and detached from the primary arms which return to their upper position. Secondary arms are used for pressing the reel drum against the roller cylinder.

Transferring a reel drum to its pre-start position as such does not take much time but requires, however, at certain intervals a crane and a person to transfer the reel drum. Sometimes, for instance when one crane is provided for several winders or if the crane is needed for other, unpredicted work, it may happen that a new reel drum is not in the pre-start position in time. Furthermore, the reel drums require a remarkably large space close to the winder in the machine hall where they must be available if they are supplied one by one to the winder.

Transfer by a crane, which is difficult to control, has a further major draw-back. As reel drums are heavy, it is difficult to eliminate vibrations which disturb the sensitive devices of the winder.

U.S. Pat. No. 3,586,253 discloses an apparatus for storing empty reel drums on support rails on top of a winder and a jumbo roll store. The reel drums are transported by cranes to the rear end of the rails which is furthest away from the winder. The drums are pushed on to the front end of the rails, which is close to the winder, by means which are driven by chains disposed inside the rails. The reel drums are pushed on until they are stopped by the previous reel already in the store. This collision may be violent if the reel drums reach too high a speed. An arm lifts up the first reel from the store over a stopper at the ends of the rails and lowers the reel to primary arms to a pre-start position. The remaining reel drums in the store roll down to the front end of the rails on their own until the first drum hits the stopper at the end of the rails. When heavy drums move also this hit can be very violent and damage the reel drums. The reel drums and the support rails of the reel drum store severely encumber the transfer of the jumbo rolls and limit the movements of the crane.

It is an object of the invention, to provide an apparatus by which reel drums can be stored in a practical way avoiding or minimizing the draw-backs mentioned above and by which reel drums can be transferred, charged to a store and lowered to the winder in a controlled manner without the disadvantages of a collision.

The method according to the present invention is primarily characterized in that the drums in the store are displaced at least by a distance corresponding to the reel drum diameter from the front end or loading and discharge end towards the rear or remote end of the store and/or the reel drum, which are at least at a distance corresponding to the diameter of the reel drum diameter from the front end, are kept in place during charging and/or discharging of a reel drum.

An apparatus according to the present invention is primarily characterized in that it comprises at least one, preferably two, movable pushing means for the transfer of the reel drums backwards away from the front or loading/discharging end of the support rails of the store and/or keeping the reel drums in place during the charge of the reel drums to the store or during the lowering the reel drums to the pre-start position.

The invention utilizes the space which usually is available above the winder and the end of a paper or a board manufacturing machine. The only space to be left free is that required by the crane above the end of the support rails which is adjacent to the winder.

The apparatus according to the invention thus allows supply of new reel drums to the front end of the rails, i.e. to the end from which the reel drums are lowered. Most of the reel drum store is independent of a crane and the store can therefore be located at the end of the machine even if there were constructions above the machine. Space for a new reel drum is arranged by displacing with pushing means the drums in the store back or away from the front end of the support rails. When no more reel drums are added to the store the pushing means are used for preventing the drums from rolling down to the front end of the rails too rapidly so as to transfer the reel drums in a controlled way without collisions which would damage the reel drums.

The apparatus according to the invention allows full automation of the reel drum exchange. The store can be filled with reel drums after which the apparatus automatically changes the drum when the jumbo roll has reached the desired web length.

The movement of the pushing means can be synchronized with the movements of the reel drum lowering arms whereby the reel drum exchange takes place in a controlled way and the reel drums in the store do not disturb the lowering of the drum.

Figure 2:
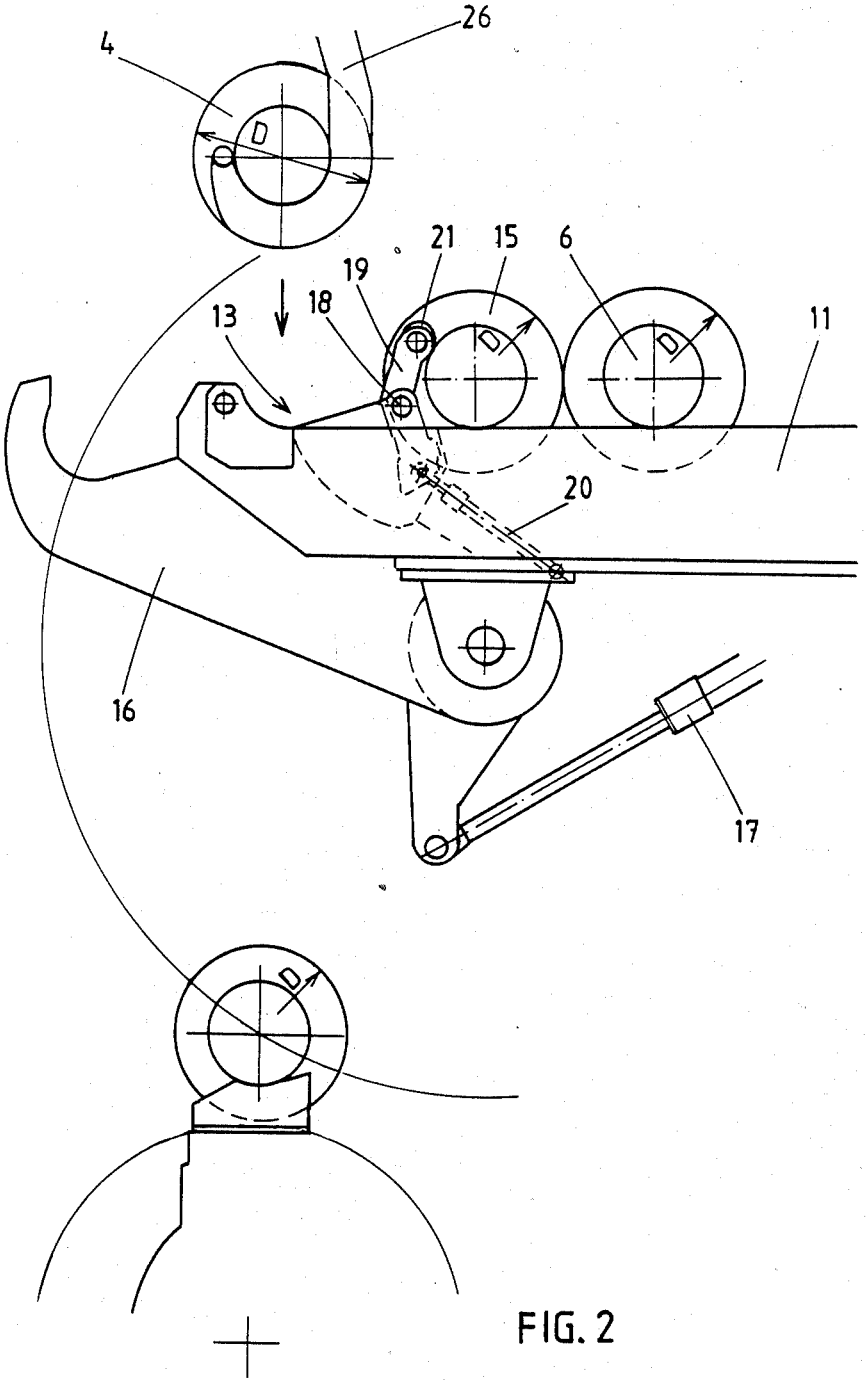

The invention is described further, by way of example with reference to the accompanying drawings illustrating an embodiment of the invention, in which FIG. 1 is a schematic elevational illustration of a winder with an apparatus for charging reel drums according to the invention;

FIG. 2 is an enlarged fragmentary detail of the apparatus of FIG. 1 illustrating reel drums being supplied to the store; and FIGS. 3 to 7 illustrate the charging apparatus of FIGS. 1 and 2 in different stages I to VI of a reel drum lowering process.

A winder illustrated in FIG. 1 comprises a roll cylinder 1 (aso-called Pope cylinder), along the periphery of which a material web 2 runs and against which a jumbo roll 3 is pressed. The roll cylinder 1 is driven by known methods by a motor (not shown). The roll cylinder 1 rotates, by means of friction, the jumbo roll 3, which is formed by a web 2 wound around a reel drum 4. The reel drum 4 is mounted on bearings in bearing housings 6 resting on rails 5. A loading roller 8, which is rotatably mounted in bearings on the ends of secondary arms 7, loads the bearing housing 6 by means of a loading cylinder 9. Support rails 11 are disposed on a frame 10 in a slightly slanting disposition and above or partly on top of the winder. Reel drums 4 are stored at 12 with their bearing housings 6 supported on the support rails 11. End stops 14 are provided at the discharge or front end 13 of the support rails 11, i.e. the ends closest to the winder. The stops 14 prevent first reel drum 15 from rolling down on its own from the support rails, which slant approx. 1 to 3 degrees downwards in the direction from the manufacturing machine (not shown) towards the winder. Lowering arms 16 are pivotably mounted via bearings on a shaft and the movement of the lowering arms 16 is controlled by a hydraulic cylinder 17. A pushing means 19 formed as an angled level, is operated by a hydraulic cylinder 20 and is pivotably mounted in bearings on an articulated pin 18 on the lowering arms 16. A pushing roller 21 is rotatably mounted in bearings at the end of the pushing means 19.

Primary arms 22 which receive the reel drum 4 when lowered to a pre-start position 23 by the lowering arms 16 are mounted on bearings on the same shaft as the roll cylinder 1. A locking means 24 prevents the reel drum 4 from falling down from the arms 22. The primary arms 22 are eccentrically mounted on bearings in such a way that in the pre-start position 23 the reel drum 4 does not yet touch the roll cylinder 1 and only touches such after the primary arms 22 have turned to transfer the reel drum 4 to a reel exchange position 25.

FIG. 2 illustrates the operation of the apparatus according to the invention, during the reel charge phase when a crane hook 26 brings a reel drum 4, the diameter of which is D, to the front end 13 of the support rails 11. The lowering arms 16 have been lifted by hydraulic cylinder 17 almost to their topmost position. Pushing means 19, which by means of articulated pin 18 is mounted on the lowering arms 16, has pushed reel drums 15, 4 towards the rear end on the rails 11, i.e. to the right hand side in the drawings, thus leaving a space of at least the diameter D for a new reel drum 4. The pushing roller 21 pushes the first reel drum 15 by its bearing housing 6. The hydraulic cylinder 20 guides the movement of the pushing means 19. When a reel drum 4 has been supplied to the front end of the store 12, the lowering arms 16 are lowered to a position whereby the pushing means 19 is no longer in contact with the reel drum 4. When the next reel drum 4 is being charged the lowering arms 16 are again raised and the pushing means 19 pushes the reel drum 4 just charged onto the rails 11 from the front end towards the rear end thus leaving space in the front end for a further reel drum 4 to be charged to the store 12.

Figure 3:
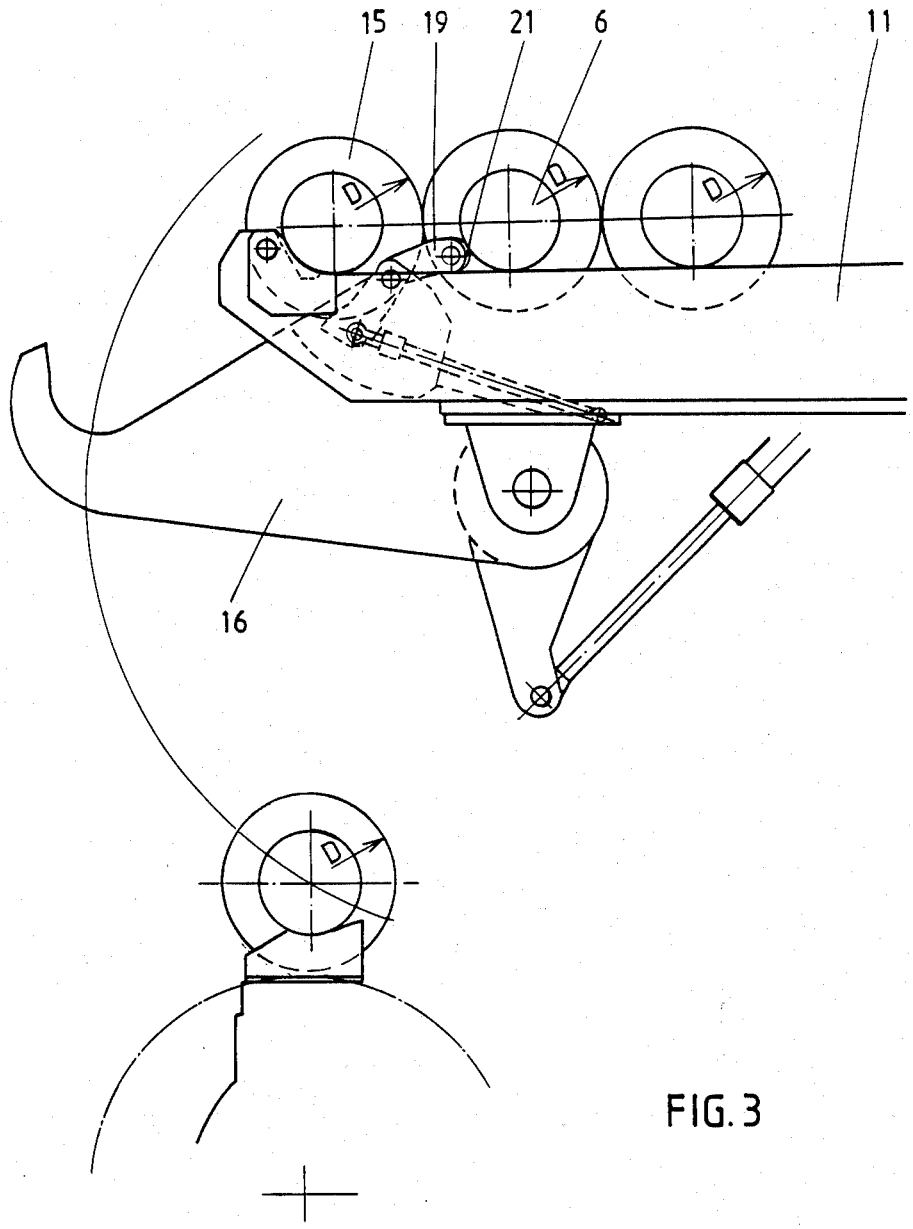

FIGS. 3 to 7 illustrate the operation of the apparatus according to the invention when reel drums 4 are lowered to a pre-start position. In FIG. 3 the lowering arm 16 is being raised (stage I) in order to fetch the first reel drum 15 from the rails 11 of the reel store 12. The pushing roller 21 of the pushing means 19 pushes the reel next to the first reel 15 by its bearing housing 6.

Figure 4:
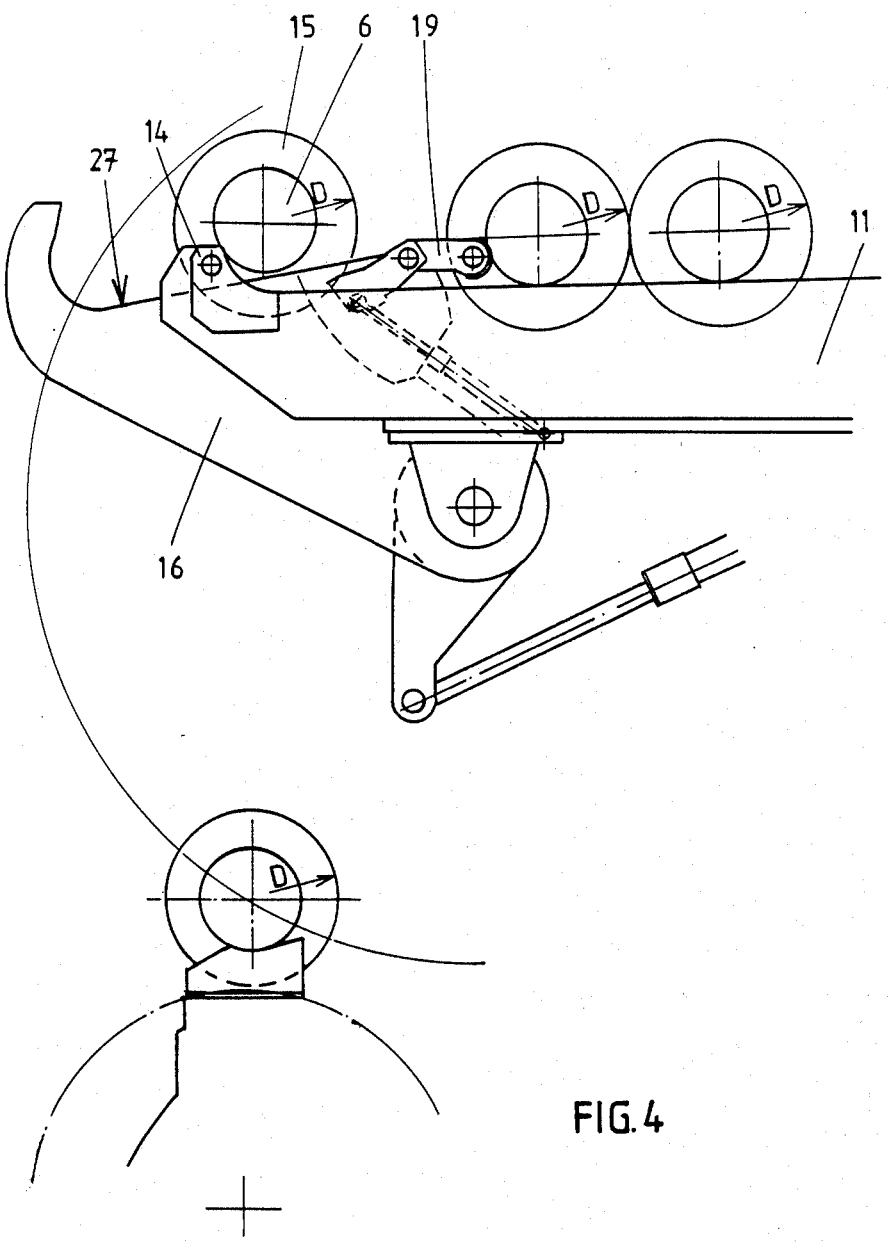

In FIG. 4 (stage II) the lowering arms 16 have been raised further whereby upper edges 27 of the lowering arms 16 support the first reel 15 by its bearing housing 6 against the end stop 14 of the support rails 11. The pushing means 19 has transferred the other rolls away from the front end.

Figure 5:
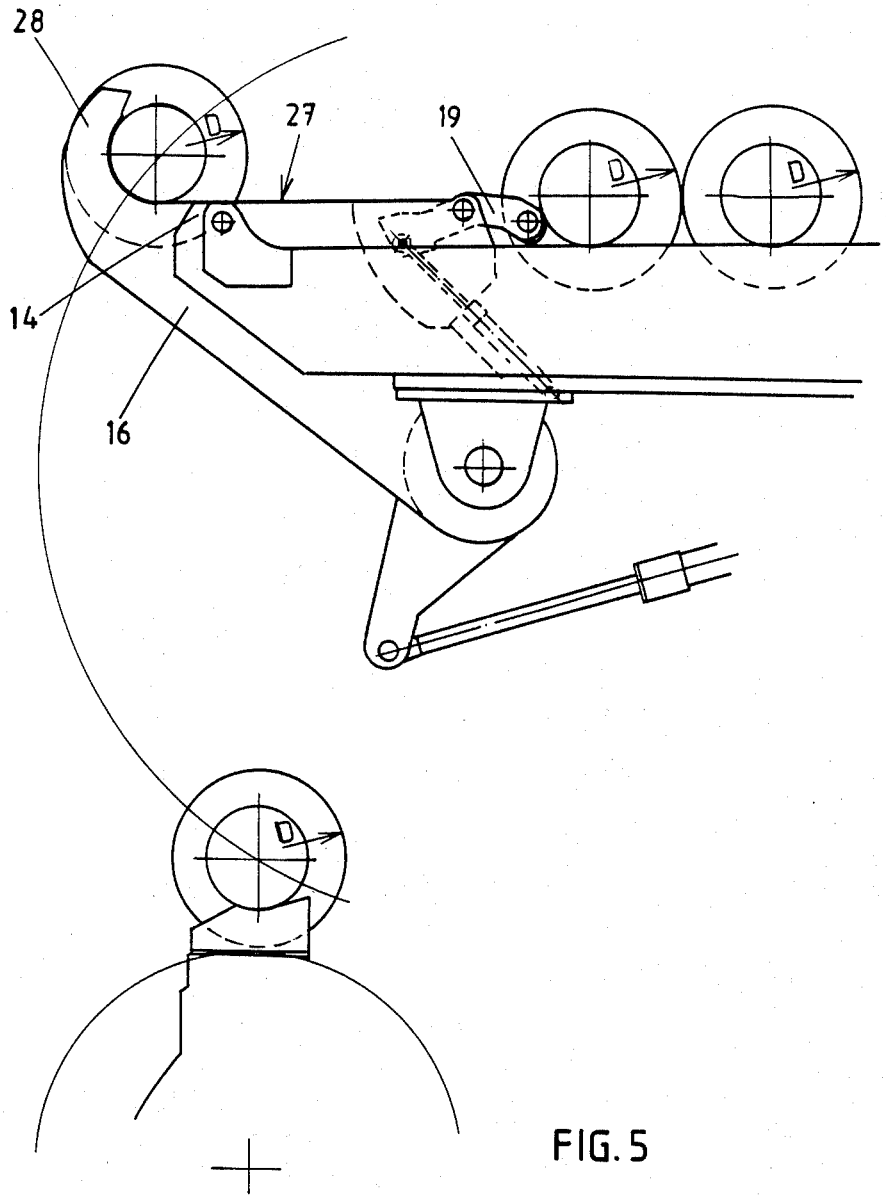
Figure 6:
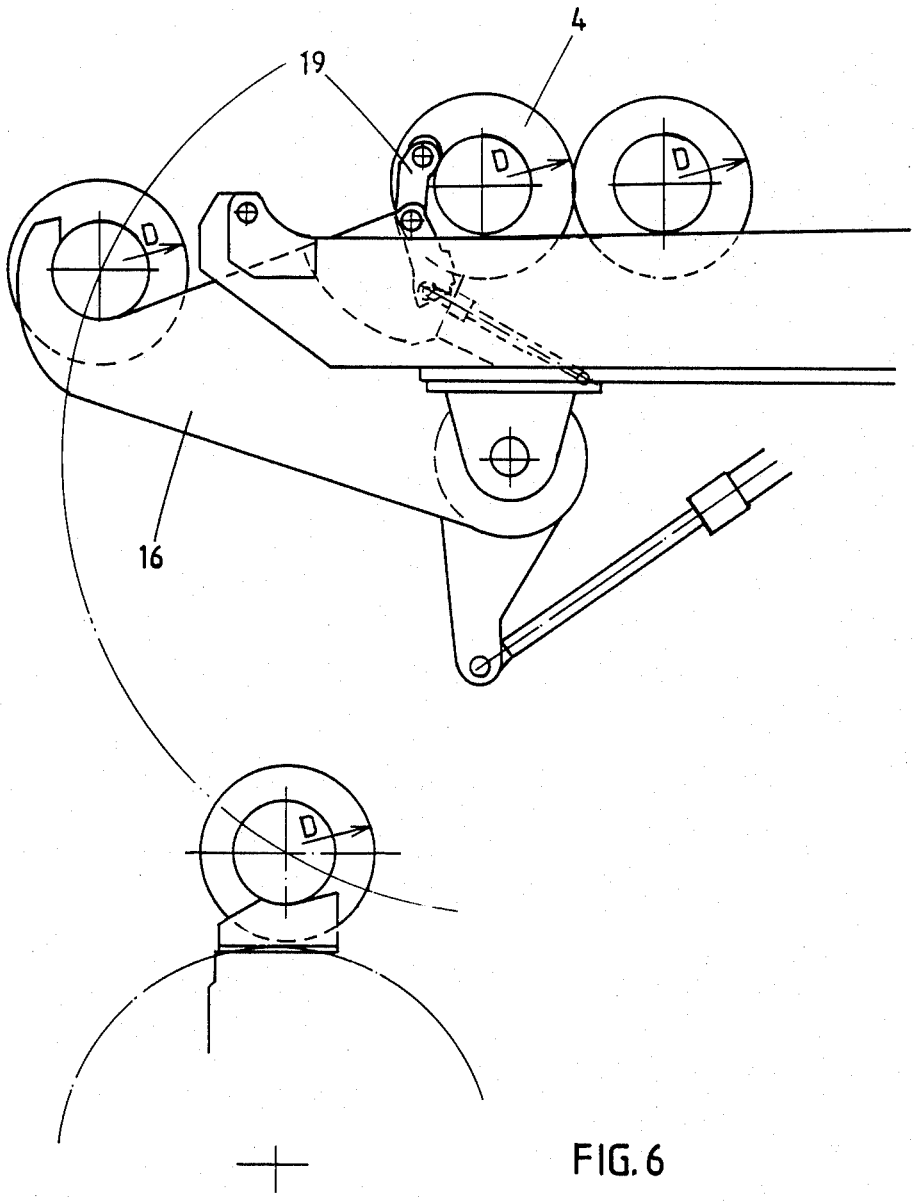
Figure 7:
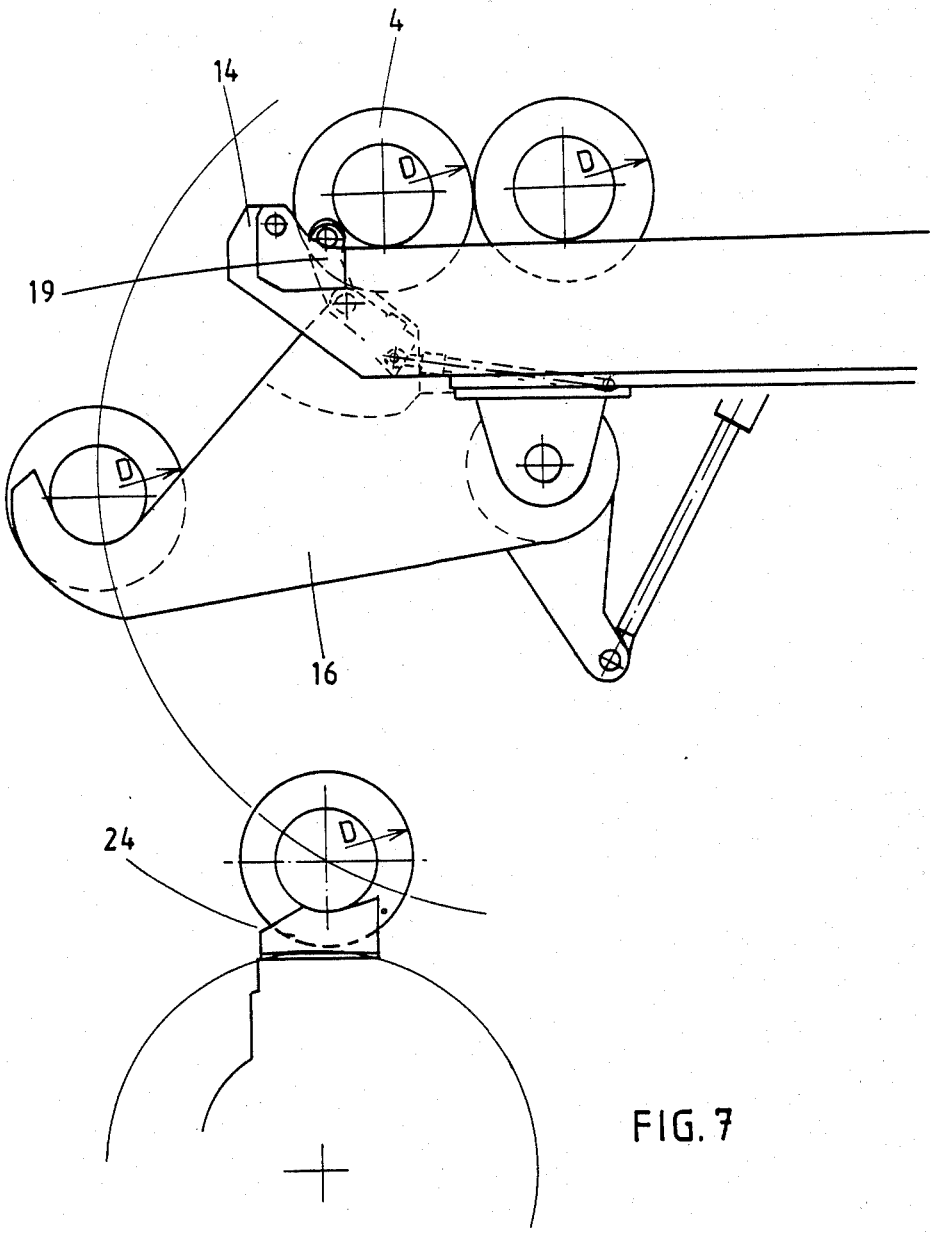

FIG. 5 illustrates the lowering arm in its highest position (stage III) whereby its upper edge 27 is on a level with the highest point of the end stop 14 and the reel drum 4 can roll to the hook-shaped portion 28 of the lowering arm 16. The pushing means 19 has not any more significantly pushed the other reel drums but keeps them in a controlled manner at a distance from the end stop 14 of the rails 11. When the lowering arms 16 descend, (stages IV to V) as illustrated in FIGS. 6 to 7, pushing means 19 controls and decelerates the reel drums 4 whilst they roll back to the end stop 14. When the lowering arms 16 lower the reel drum 15 (4) to the primary arms 22 on the roller cylinder 1, the pushing means 19 is no longer in contact with the reel drums 4 in the store 12.

Connecting the pushing means to the lowering arm is usually advantageous but in some spacial cases, the pushing means can be connected to the rails and driven and controlled by various means.

Because of the constructions above the winder and possibly for other reasons, it may be advantageous to supply reel drums to the store for instance to a position between the first and the second reel drum seen from the front end of the store, in which case the pushing means is arranged to push all other reel drum except the first one.

In the embodiment presented here by way of example, the pushing means is controlled by a hydraulic cylinder, which is favourable for instance for automation. Naturally it is possible to arrange the movements of the pushing means dependent on the movements of the lowering arms, for example by lever arms.

The invention is not limited to the embodiments presented here as an example only but it can, within the scope of protection defined by the appending patent claims, be applied also to other kinds of winders or roll handling apparatus.

What is claimed is:

1. A method of supplying reel drums for a winder of a paper or board making machine to a discharge end of a store disposed above the winder, and of lowering reel drums from the store during a reel drum exchange, the method comprising the steps of:

(a) supplying a new reel drum to an area adjacent the front or discharge end of said store;

(b) moving a drum or drums already in the store rearwardly away from the said discharge end of said store;

(c) placing said new reel drum in said store at said discharge end thereof, ahead of said drum or drums already in the store;

(d) repeating steps (a) through (c) until the desired number of drums are in said store; and (e) removing the most recently supplied reel drum from the discharge end of the store to a pre-start position for a reel drum exchange by moving all but said most recently supplied reel drum rearwardly away from said discharge end while the said most recently supplied drum is removed to said pre-start position.

2. A method as recited in claim 1, wherein step (b) is carried out by moving the drum or drums already in the store rearwardly a distance equal to at least the diameter of one of said reel drums, and holding said reel drums at said distance until step (c) is completed.

3. A method as recited in claim 1, wherein in step (e) said drums are moved rearwardly a distance equal to at least the diameter of one of said reel drums, and wherein step (e) includes the further step of holding said drums at said distance until step (e) is completed.

4. A method as recited in claim 3, and further comprising the step of, after said most recently supplied drum is removed in step (e), returning the remaining drums in said store toward the discharge end of said store in a controlled deceleration.

5. Apparatus for supplying reel drums for a winder of a paper or board manufacturing machine to a store, and for lowering said drums, one by one, during a reel drum exchange, comprising:

(a) means for supporting a plurality of said drums for rolling movement in said store above said winder, one of said plurality of drums located at said discharge end of said store;

(b) means for supplying new drums to the discharge end of said store ahead of the one of said plurality of drums; and (c) means for removing a first of said drums closest to said discharge end from said store and positioning said first of said drums at a pre-start location during a drum exchange.

6. Apparatus as defined in claim 5, wherein said supporting means comprises a pair of support rails, first ends of which are located at said discharge end, and wherein said first ends of said rails are provided with stop means for limiting rolling movement of said drums in said store.

7. Apparatus as defined in claim 5, wherein said means for supplying drums to the discharge end of said store includes crane means and at least a pair of pushing means for pushing drums already in said store along said support rails away from said discharge end, thereby permitting said crane means to supply one of said new drums to said discharge end of said store.

8. Apparatus as defined in claim 7, wherein said means for removing said first of said drums from the store during a drum exchange comprises at least a pair of pivotally mounted lowering arms.

9. Apparatus as defined in claim 8, wherein said support rails incline downwardly toward said discharge end and wherein said pushing means also control and decelerate said drums as they roll toward said discharge end after said first of said drums is removed.

10. Apparatus as defined in claim 8, wherein each of said lowering arms is connected to one of said pushing means.

11. Apparatus as defined in claim 10, wherein said pushing means are operable to push all but said first of said drums in said store rearwardly away from said discharge upon actuation of said lowering arms during a reel drum exchange.

12. Apparatus as defined in claim 10, wherein each of said lowering arms and said pushing means are actuated by first and second fluid actuated means, respectively.

13. Apparatus as defined in claim 12, wherein, said first and second fluid actuating means comprise first and second hydraulic cylinders.

14. Apparatus as defined in claim 12 wherein each of said pushing means comprises a lever having a first end which supports a pushing roller, and a second end connected to said second fluid actuating means, said lever pivotally connected intermediate its ends to one of said lowering arms.

15. Apparatus as defined in claim 7, wherein said pushing means includes rollers which are adapted to engage bearing housings of said reel drums.

* * * * *